US005266221A

United States Patent [19]

Kleber et al.

[11] Patent Number: 5,266,221

[45] Date of Patent: Nov. 30, 1993

[54] BIODEGRADABLE SPIN FINISHES

[75] Inventors: Rolf Kleber, Neu-Isenburg; Lothar Jaeckel, Flösheim am Main, both of Fed. Rep. of Germany

[73] Assignee: Hoechst Aktiengesellschaft, Frankfurt am Main, Fed. Rep. of Germany

[21] Appl. No.: 961,445

[22] Filed: Oct. 15, 1992

[30] Foreign Application Priority Data

Oct. 19, 1991 [DE] Fed. Rep. of Germany ..... 4134610

[51] Int. Cl.[5] ..... D06M 13/17; D06M 15/53

[52] U.S. Cl. ..... 252/8.9; 252/8.6; 428/361; 428/395

[58] Field of Search ..... 252/8.6, 8.9; 428/361, 428/395, 413; 427/393.5, 389.9, 424, 434.6, 390 R

[56] References Cited

U.S. PATENT DOCUMENTS

| | | | |
|---|---|---|---|
| 4,179,544 | 12/1979 | Newkirk et al. | 428/395 |
| 4,198,464 | 4/1980 | Login et al. | 428/361 |
| 4,256,589 | 3/1981 | Carver et al. | 252/8.7 |
| 4,552,671 | 11/1985 | Ogiso et al. | 252/8.9 |
| 4,789,381 | 12/1988 | Oshiyama et al. | 252/8.6 X |
| 4,880,906 | 11/1989 | Esselborn et al. | 252/8.9 X |
| 5,066,414 | 11/1991 | Chang | 252/8.9 X |
| 5,079,076 | 1/1992 | Lal | 252/8.9 X |
| 5,126,060 | 6/1992 | Puentes-Bravo et al. | 252/8.6 |

FOREIGN PATENT DOCUMENTS

| | | |
|---|---|---|
| 0189804 | 8/1986 | European Pat. Off. . |
| 0166958 | 1/1988 | European Pat. Off. . |
| 3936975 | 1/1991 | Fed. Rep. of Germany . |
| 2017100 | 10/1979 | United Kingdom . |
| 2109403 | 6/1983 | United Kingdom . |

*Primary Examiner*—Arthur C. Prescott

[57] ABSTRACT

The invention relates to spin finishes which contain compounds of the formula $$HO(CH_2CH_2O)_x—RO—(CH_2CH_2O)_yH \quad \text{I}$$

in which

R is an alkylene radical which is mono- or polysubstituted by alkyl, has 2 to 4 carbon atoms in the alkylene chain and contains methyl, ethyl, propyl or isopropyl as the alkyl substituent, and the sum of x and y is 10 to 20, x and y being different from zero, and to a process for the spin finishing of fibers.

11 Claims, No Drawings

BIODEGRADABLE SPIN FINISHES

U.S. Pat. No. 4,179,544 discloses polyoxyalkylene glycols which, in a heat treatment of spin finished synthetic fibers, such as texturing, evaporate without leaving a residue, so that, when using them in spin finishes, the intervals at which the texturing means used are cleaned are relatively long. EP-B-162,530 discloses end-capped polyoxyalkylene glycols which have goods properties as spin finishes and are also distinguished by low residue formation on the fiber after heating processes.

However, the great disadvantage of all these compounds is their only moderate biodegradability. In recent years, additional demands have been made on spin finishes to the effect that they should be readily biodegradable in the waste water. The objective of these demands is to eliminate the spin finishes entering the waste water of textile plants during dyeing or pretreatment by biodegradation. The term "biodegradable" is to be understood as meaning that the components of spin finishes, such as lubricants, surfactants, yarn cohesifiers or else antistats, are biodegraded completely or at least to the extent of 70% by weight, for example by the enzymes or bacteria present in the sewage sludge of a water treatment plant. It is desirable that this degradation produce chemically simple compounds, such as carbon dioxide, water, sulfate or phosphate.

A number of test procedures have been developed for evaluating the biodegradability of chemical compounds. The "coupled units test" (OECD 303 A Test) is mentioned as a suitable method for testing the biodegradability of spin finishes.

It is still very difficult to prepare biodegradable spin finishes. This is what the invention seeks to remedy.

The invention relates to spin finishes comprising compounds of the formula $$HO(CH_2CH_2O)_x—RO—(CH_2CH_2O)_yH \qquad I$$

in which

R is an alkylene radical which is mono- or polysubstituted by alkyl, has 2 to 4 carbon atoms in the alkylene chain and contains methyl, ethyl, propyl or isopropyl as the alkyl substituent, and the sum of x and y is 10 to 20, x and y being different from zero.

Preferred components of these biodegradable spin finishes are compounds of the formula I in which R is a 1-methylpropylene radical, 2-methylpropylene radical or a 2,2-dimethylpropylene radical, particularly preferably a 1-methylethylene radical (isopropylene radical).

These compounds of the formula I are prepared by the process described in EP-B-166,958 by reacting a glycol with ethylene oxide.

Owing to their unexpectedly low residue formation in heating processes such as texturing, and their surprisingly good biodegradability, the compounds of the formula I are highly suitable for use as spin finishes. The compounds of the formula I are in general water-soluble or water-dispersible. They can be used as spin finishes either by themselves or in a mixture with one another or with other spin finish components known per se, such as surfactants, antistats, such as $P_2O_5$ ester salts, lubricants, such as ester oils, or yarn cohesifiers, such as ethoxylated castor oils, which must also be biodegradable.

If a mixture of the compounds of the formula I with known spin finish components is used, the relative amount of the compounds of the formula I should be in the range from 10 to 100 parts by weight, relative to the spin finish. When synthetic fibers are spin finished using compounds of the formula I or mixtures thereof, the addon should be 0.1 to 1%, preferably 0.3 to 0.5% on weight of fiber, the compounds of the formula I being present in the spin finish in accordance with the percentages given above.

The spin finishes can be applied from aqueous solution, dispersion or emulsion, if appropriate with additional use of suitable solvents or dispersants.

Since the majority of the compounds of the formula I are readily water-soluble, they can be applied to the fiber, unlike mineral or ester oils, without the need for additional emulsifiers.

Application takes place by customary methods, for example by face-padding, dipping, spraying, dip-adding or by means of gear pumps.

Examples of suitable synthetic fibers for which the spin finshes are to be used are fibers made of polyesters, polyamides, polyacrylonitrile, polyolefins or copolymers of the abovementioned compounds.

General procedure for preparing the acetals mentioned below:

The amounts of glycol and alkaline catalyst are initially introduced into a reaction vessel equipped with a stirrer. After flushing with nitrogen to remove the oxygen, the mixture is heated to 120° to 125° C. and kept at this temperature under a water pump vacuum for 2 hours with stirring. After removing the water pump vacuum, the mixture is heated to 130° to 140° C. with stirring, after which the required amount of gaseous ethylene oxide is metered in at this temperature over a period of about 3 hours. The end of ethylene oxide addition is indicated by the pressure which decreases and remains essentially constant. In order to purify the reaction product by removing any volatile components which may be present, it is maintained at about 80° C. and a vacuum of 2 kPa for half an hour with stirring.

The initially introduced glycols and alkaline catalysts and the amount of ethylene oxide metered in at the reaction temperature and the reaction pressure are summarized in Table I below.

TABLE I

| Example No. | Glycol (g) | Glycol (mol) | Ethylene oxide (g) | Ethylene oxide (mol) | Catalyst Type | Catalyst (% by weight) | Reaction temperature (°C.) | Reaction pressure (kPa) |
|---|---|---|---|---|---|---|---|---|
| 1 | 1,2-Propylene-glycol 76.0 | 1.0 | 510.4 | 11.6 | NaOH | 1.0 | 140–150 | 50–400 |
| 2 | 1,2-Propylene-glycol 76.0 | 1.0 | 660.0 | 15.0 | $Na_2CO_3$ | 3.0 | 140–150 | 30–300 |

TABLE I-continued

| Example No. | Glycol (g) | Glycol (mol) | Ethylene oxide (g) | Ethylene oxide (mol) | Catalyst Type | Catalyst (% by weight) | Reaction temperature (°C.) | Reaction pressure (kPa) |
|---|---|---|---|---|---|---|---|---|
| 3 | 1,2-Propylene-glycol 76.0 | 1.0 | 880.0 | 20.0 | $K_2CO_3$ | 2.5 | 140–150 | 50–400 |
| 4 | 1,2-Propylene-glycol 76.0 | 1.0 | 1276.0 | 29.0 | NaOH | 2.0 | 120–140 | 50–400 |

Test of the evaporation rate of Examples 1 to 4

In the evaporation test, 1 g each of the Examples 1 to 4 listed in Table I are maintained at 220° C., and the losses at 0.33 hour (20 minutes) and 24 hours are evaluated. The losses of Examples 1 to 4 in percent can be seen from Table II.

TABLE II

| Example No. | Duration 20 minutes | Duration 24 hours |
|---|---|---|
| 1 | 9% | >95% |
| 2 | 8% | >95% |
| 3 | 7% | >95% |
| 4 | 6% | >95% |

Biodegradability test

The biodegradability is determined by means of the OECD 303 A test. In this test, the biological elimination [% DOC] is determined as a function of time [d] (d=day).

Table III indicates the maximum value of biological elimination after 28 days.

TABLE III

| Example No. | Biological elimination [%] | Time [d] |
|---|---|---|
| 1 | >90% | 28 |
| 2 | >90% | 28 |
| 3 | >90% | 28 |
| 4 | >90% | 18 |

What is claimed is:

1. A spin finish composition comprising a compound of the formula $$HO(CH_2CH_2O)_x—RO—(CH_2CH_2O)_yH$$

in which

R is an alkylene radical which is mono- or polysubstituted by alkyl, has 2 to 4 carbon atoms in the alkylene chain and contains methyl, ethyl, or propyl or isopropyl as the alkyl substituent, and the sum of x and y is 10 to 20, x and y being different from zero, said compound being mixed with a biodegradable or non-biodegradable antistat, a yarn cohesifier, a lubricant, a solvent, a dispersant, or a combination thereof.

2. A spin finish composition as claimed in claim 1, wherein the content of the compound or compounds of the formula I is in the range from 10 to 100 parts by weight, relative to the spin finish composition.

3. A spin finish composition as claimed in claim 1, wherein the biodegradability of the composition is above 90% by weight.

4. A process for the spin finishing of fibers, comprising the step of adding onto the fiber a spin finish composition as claimed in claim 1 in the range from 0.1 to 1.0% by weight, relative to the weight of the fiber.

5. A process for the spin-finishing of a fiber, comprising the step of applying to the fiber a compound of the formula $$HO(CH_2CH_2O)_x—RO—(CH_2CH_2O)_yH$$

in which

R is an alkylene radical which is mono- or polysubstituted by alkyl, has 2 to 4 carbon atoms in the alkylene chain and contains methyl, ethyl, or propyl or isopropyl as the alkyl substituent, and the sum of x and y is 10 to 20, x and y being different from zero.

6. A process as claimed in claim 5, wherein the amount of said compound added onto the fiber is in the range from 0.1 to 1.0% by weight, relative to the weight of the fiber.

7. A fiber which has been treated by the process as claimed in claim 5.

8. A fiber as claimed in claim 7, wherein said fiber comprises a polymer which is at least one of the following: polyester, polyamide, polyacrylonitrile, polyolefin, or a copolymer thereof.

9. A process as claimed in claim 5, wherein a spin finish composition comprising a said compound and a biodegradable or non-biodegradable antistat, a yarn cohesifier, a lubricant, a solvent, a dispersant, or a combination thereof is applied to the fiber.

10. A process as claimed in claim 9, wherein the content of the compound or compounds of formula I is in the range of 10 to 100 parts by weight, relative to the spin finish composition.

11. A process as claimed in claim 9, wherein the biodegradability of the spin finish composition is above 90% by weight.

* * * * *